US011913328B1

(12) United States Patent
Affleck et al.

(10) Patent No.: US 11,913,328 B1
(45) Date of Patent: Feb. 27, 2024

(54) SUBSURFACE ANNULAR PRESSURE MANAGEMENT SYSTEM—A METHOD AND APPARATUS FOR DYNAMICALLY VARYING THE ANNULAR WELL PRESSURE

(71) Applicant: SAUDI ARABIAN OIL COMPANY, Dhahran (SA)

(72) Inventors: Michael Anthony Affleck, Aberdeen (GB); Krzysztof Karol Machocki, Aberdeen (GB)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/062,836

(22) Filed: Dec. 7, 2022

(51) Int. Cl.
*E21B 47/24* (2012.01)

(52) U.S. Cl.
CPC ..... *E21B 47/24* (2020.05); *E21B 2200/02* (2020.05)

(58) Field of Classification Search
CPC ..... E21B 47/24; E21B 2200/02
See application file for complete search history.

(56) References Cited

U.S. PATENT DOCUMENTS 5,660,238 A * 8/1997 Earl ..... E21B 47/18 166/250.01
5,740,127 A * 4/1998 Van Steenwyk ..... E21B 47/24 33/307
5,836,353 A * 11/1998 Van Steenwyk ..... E21B 47/24 251/30.01
6,182,764 B1 * 2/2001 Vaynshteyn ..... E21B 34/16 367/83
9,279,298 B2 3/2016 Lewis
10,494,885 B2 12/2019 Lehr
2002/0157837 A1 * 10/2002 Bode ..... E21B 23/006 166/227
2006/0157282 A1 * 7/2006 Tilton ..... E21B 21/14 175/426
2016/0123112 A1 * 5/2016 Purkis ..... E21B 34/14 166/330

* cited by examiner

*Primary Examiner* — James G Sayre
(74) *Attorney, Agent, or Firm* — Osha Bergman Watanabe & Burton LLP

(57) ABSTRACT

A downhole tool includes a choke, a controller, a communication and power element, instrumentation, and a stabilizer. The choke is configured to vary an annular well pressure. The choke includes an expandable element having an expanded position, an expanding position, and an unexpanded position. The controller is connected to the choke and is configured to place the choke in the expanded position, the expanding position, and the unexpanded position. The communication and power element is electronically connected to the controller. Power and instructions are sent to the controller from the communication and power element. The instrumentation is electronically connected to the communication and power element. The instrumentation comprises sensors configured to obtain downhole data and the downhole data is sent to the communication and power element. The stabilizer is configured to centralize the choke within the casing string.

20 Claims, 9 Drawing Sheets

SUBSURFACE ANNULAR PRESSURE MANAGEMENT SYSTEM—A METHOD AND APPARATUS FOR DYNAMICALLY VARYING THE ANNULAR WELL PRESSURE

BACKGROUND

Hydrocarbons are located in porous rock formations located far beneath the surface of the Earth. Wells are drilled into the formations to access and produce the hydrocarbons. Wells are formed by drilling a wellbore using a drill bit connected to a drill string. The drill bit breaks down the rock and drilling fluid removes the rock cuttings from the wellbore. Drilling fluid is also used to manage downhole pressures and stabilize the wellbore. When drilling a well, it is important to keep the wellbore pressure within a formation pressure window. The formation pressure window is delineated by the fracture pressure of the formation and the pore pressure of the formation. Drilling fluid is used to manage the wellbore pressure and keep the wellbore pressure within the formation pressure window.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

This disclosure presents, in accordance with one or more embodiments methods and systems for deploying a downhole tool in a casing string. The downhole tool includes a choke, a controller, a communication and power element, instrumentation, and a stabilizer. The choke is configured to vary an annular well pressure. The choke includes an expandable element having an expanded position, an expanding position, and an unexpanded position. The expanded position comprises the expandable element sealed against an inner circumferential surface of the casing string. The controller is connected to the choke and is configured to place the choke in the expanded position, the expanding position, and the unexpanded position. The communication and power element is electronically connected to the controller. Power and instructions are sent to the controller from the communication and power element. The instrumentation is electronically connected to the communication and power element. The instrumentation comprises sensors configured to obtain downhole data and the downhole data is sent to the communication and power element. The stabilizer is configured to centralize the choke within the casing string.

The method includes deploying the downhole tool in the casing string. The downhole tool includes a choke comprising an expandable element having an expanded position, an expanding position, and an unexpanded position, a controller connected to the choke, a communication and power element electronically connected to the controller, instrumentation electronically connected to the communication and power element, and a stabilizer configured to centralize the choke within the casing string. The method further includes centralizing the choke within the casing string using the stabilizer, sending power and instructions to the controller using the communication and power element, varying an annular well pressure by activating the choke to place the expandable element in the expanded position, the expanding position, or the unexpanded position using the controller, obtaining downhole data using sensors located in the instrumentation, and sending the downhole data to the communication and power element.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Embodiments disclosed herein relate to a method and apparatus for a drilling system that enables dynamic variation of annular backpressure during drilling operations where the rig mud pumps are continually circulating drilling fluids (when with traditional methods, circulation would stop), such as during connections, required for tripping or drilling ahead. In one or more embodiments, a simpler, downhole based solution is proposed, controlled either from surface, through a downhole controller or a combination of both. In modulating the annular pressure profile downhole, no additional annular pressure varying equipment is required at surface, making both installation and operation simpler.

Figure 1:
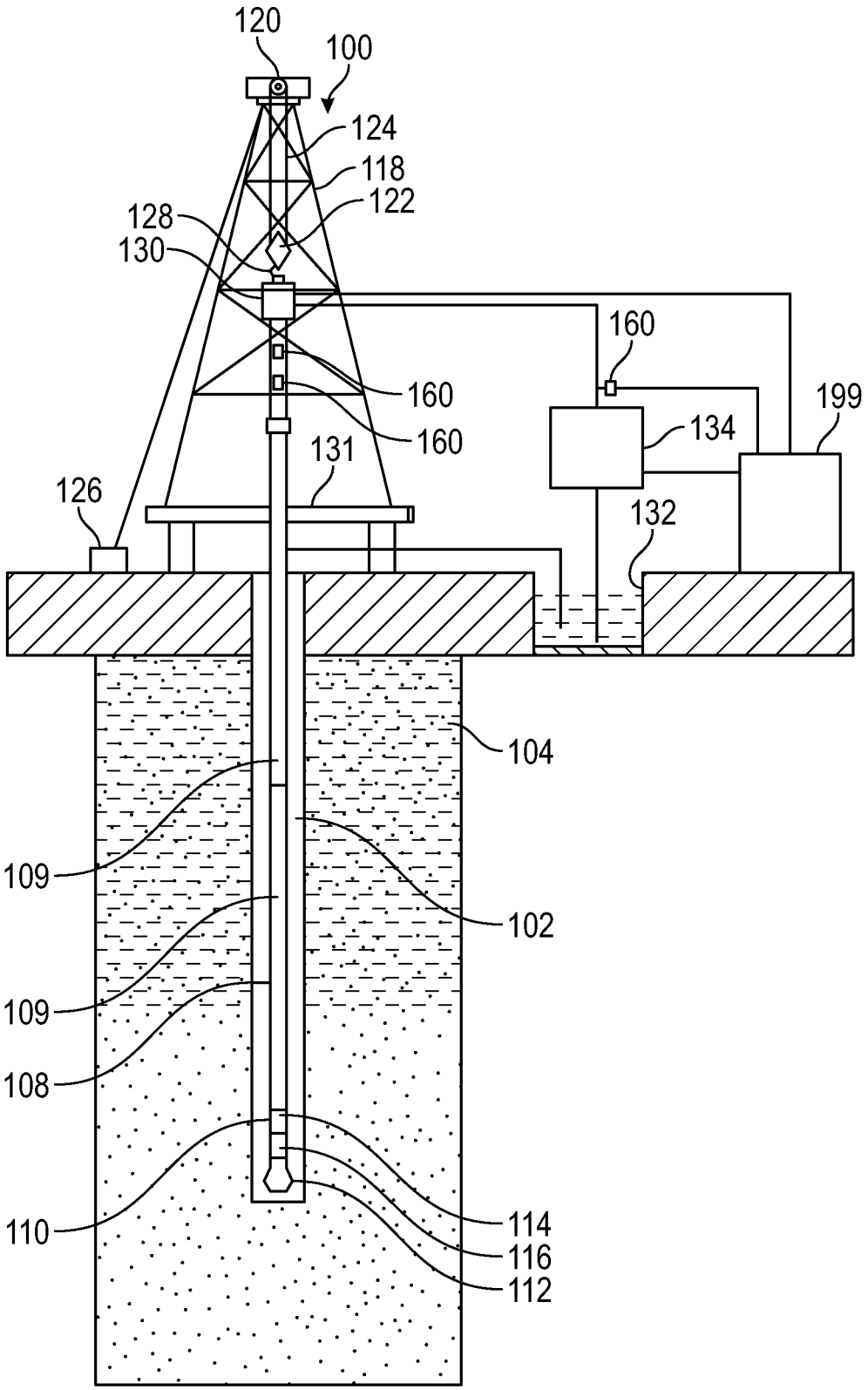
FIG. 1 shows an example well site in accordance with one or more embodiments.

FIG. 1 shows an example well site (100) in accordance with one or more embodiments. In general, well sites may be configured in a myriad of ways. Therefore, well site (100) is not intended to be limiting with respect to the particular configuration of the drilling equipment. The well site (100) is depicted as being on land. In other examples, the well site (100) may be offshore, and drilling may be carried out with or without use of a marine riser. A drilling operation at well site (100) may include drilling a wellbore (102) into a subsurface including various formations (104). For the purpose of drilling a new section of wellbore (102), a drill string (108) is suspended within the wellbore (102).

The drill string (108) may include one or more drill pipes (109) connected to form conduit and a bottom hole assembly (BHA) (110) disposed at the distal end of the conduit. The BHA (110) may include a drill bit (112) to cut into the subsurface rock. The BHA (110) may include measurement tools, such as a measurement-while-drilling (MWD) tool (114) and logging-while-drilling (LWD) tool 116. Measurement tools (114, 116) may include sensors and hardware to measure downhole drilling parameters, and these measurements may be transmitted to the surface using any suitable telemetry system known in the art. Herein, the term surface is defined as any location located outside of the wellbore (102), such as somewhere on the Earth's surface, on a man-made object located on the Earth's surface, etc. The BHA (110) and the drill string (108) may include other drilling tools known in the art but not specifically shown.

The drill string (108) may be suspended in wellbore (102) by a derrick (118). A crown block (120) may be mounted at the top of the derrick (118), and a traveling block (122) may hang down from the crown block (120) by means of a cable or drilling line (124). One end of the cable (124) may be connected to a drawworks (126), which is a reeling device that may be used to adjust the length of the cable (124) so that the traveling block (122) may move up or down the derrick (118). The traveling block (122) may include a hook (128) on which a top drive (130) is supported.

The top drive (130) is coupled to the top of the drill string (108) and is operable to rotate the drill string (108). Alternatively, the drill string (108) may be rotated by means of a rotary table (not shown) on the drilling floor (131). Drilling fluid (commonly called mud) may be stored in a mud pit (132), and at least one pump (134) may pump the mud from the mud pit (132) into the drill string (108). The mud may flow into the drill string (108) through appropriate flow paths in the top drive (130) (or a rotary swivel if a rotary table is used instead of a top drive to rotate the drill string (108)).

In one implementation, a system (199) may be disposed at or communicate with the well site (100). System (199) may control at least a portion of a drilling operation at the well site (100) by providing controls to various components of the drilling operation. In one or more embodiments, system (199) may receive data from one or more sensors (160) arranged to measure controllable parameters of the drilling operation. As a non-limiting example, sensors (160) may be arranged to measure WOB (weight on bit), RPM (drill string rotational speed), GPM (flow rate of the mud pumps), and ROP (rate of penetration of the drilling operation).

Sensors (160) may be positioned to measure parameter(s) related to the rotation of the drill string (108), parameter(s) related to travel of the traveling block (122), which may be used to determine ROP of the drilling operation, and parameter(s) related to flow rate of the pump (134). For illustration purposes, sensors (160) are shown on drill string (108) and proximate mud pump (134). The illustrated locations of sensors (160) are not intended to be limiting, and sensors (160) could be disposed wherever drilling parameters need to be measured. Moreover, there may be many more sensors (160) than shown in FIG. 1 to measure various other parameters of the drilling operation. Each sensor (160) may be configured to measure a desired physical stimulus.

During a drilling operation at the well site (100), the drill string (108) is rotated relative to the wellbore (102), and weight is applied to the drill bit (112) to enable the drill bit (112) to break rock as the drill string (108) is rotated. In some cases, the drill bit (112) may be rotated independently with a drilling motor. In further embodiments, the drill bit (112) may be rotated using a combination of the drilling motor and the top drive (130) (or a rotary swivel if a rotary table is used instead of a top drive to rotate the drill string (108)). While cutting rock with the drill bit (112), mud is pumped into the drill string (108).

The mud flows down the drill string (108) and exits into the bottom of the wellbore (102) through nozzles in the drill bit (112). The mud in the wellbore (102) then flows back up to the surface in an annular space between the drill string (108) and the wellbore (102) with entrained cuttings. The mud with the cuttings is returned to the pit (132) to be circulated back again into the drill string (108). Typically, the cuttings are removed from the mud, and the mud is reconditioned as necessary, before pumping the mud again into the drill string (108). In one or more embodiments, the drilling operation may be controlled by the system (199).

When drilling a well, it is important to ensure the wellbore (102) pressure stays between the fracture pressure and the pore pressure of the formations (104) through which the wellbore (102) extends through. The wellbore (102) pressure is primarily controlled by the density of the drilling fluid. The density of the drilling fluid is initially set on the surface by weighting up or weighting down the drilling fluid using weighting materials.

Figure 2:
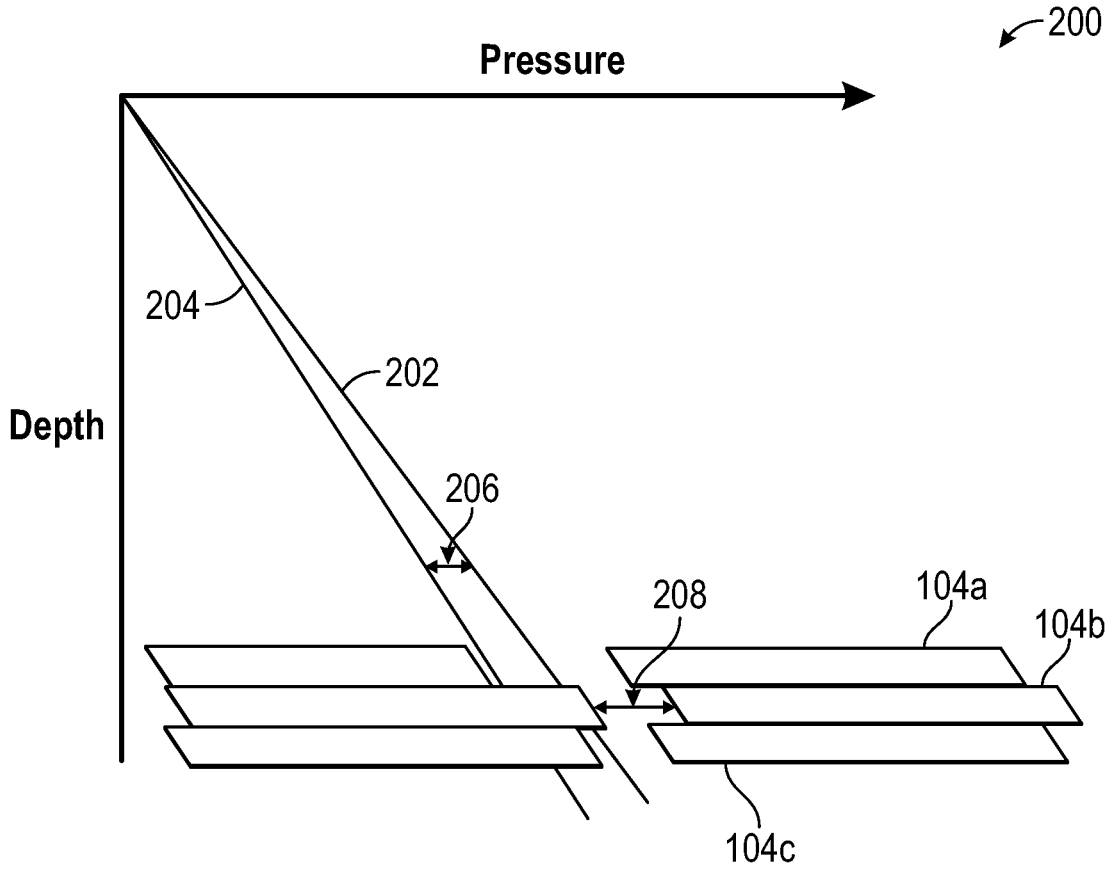
FIG. 2 shows a wellbore pressure profile in accordance with one or more embodiments.

FIG. 2 shows a wellbore pressure profile (200) in accordance with one or more embodiments. Specifically, FIG. 2 is a graph of pressure vs. depth. Pressure is shown on the x-axis and depth is shown on the y-axis. A line representing the equivalent circulating density (ECD) gradient (202) of the drilling fluid having a density, and a line representing the equivalent static density (ESD) gradient (204) of the drilling fluid having a density are plotted on the graph.

The ESD gradient (204) represents the wellbore pressure profile (200) when the wellbore (102) is in a steady state condition (i.e., the mud pumps (134) are off, and the drilling fluid is static within the wellbore (102)). The ECD gradient (202) represents the wellbore pressure profile (200) when the wellbore (102) is in a dynamic or circulation condition (i.e., the mud pumps (134) are on, and the drilling fluid is being circulated within the wellbore (102)).

As shown in FIG. 2, both the ESD gradient (204) and the ECD gradient (202) increases as the wellbore (102) become deeper. However, the ECD gradient (202) increases at a higher rate than the ESD gradient (204) due, in part, to friction pressure caused by the drilling fluid being pumped through the drilling equipment. The space between the ESD gradient (204) and the ECD gradient (202) is called the operating window (206).

It is assumed that when the mud pumps (134) are off, the wellbore pressure profile (200) is equivalent to the ESD gradient (204). When the mud pumps (134) are turned on and the drilling fluid is transitioning between static and dynamic conditions, the wellbore pressure profile (200) is somewhere within the operating window (206). When the drilling operation is operating under a continuous circulation system (CCS) (i.e., the mud pumps (134) are on, and the drilling fluid has been circulating for a period of time), it is assumed that the wellbore pressure profile (200) is equal to the ECD gradient (202).

The wellbore pressure profile (200) should stay within the formation pressure window (208) (i.e., between the fracture pressure and the pore pressure of the formation (104)) to prevent fracturing the formation (104) or to prevent a kick of formation (104) fluids from entering the wellbore (102). Normally pressured formations (104) are formations (104) that have formation (104) pressures equal to the hydrostatic pressure of water extending from the surface to the subsurface formation (104).

When drilling through normally pressured formations (104), it is relatively simple to estimate the formation pressure window (208) of each formation (104) and drill within the formation pressure window (208) using a CCS. Abnormally pressured formations (104) are formations (104) that have a formation pressure window (208) that is above or below the normal hydrostatic pressure gradient.

FIG. 2 shows three formations (104): formation A (104*a*), formation B (104*b*), and formation C (104*c*). Formation B (104*b*) is abnormally pressured and has a pore pressure higher than the ECD gradient (202) at that depth. Drilling through formation B (104*b*) at the shown drilling fluid density would cause a kick of formation (104) fluids to enter the wellbore (102). As such, the density of the drilling fluid would need to be increased in order to safely drill through formation B (104*b*).

It is a time consuming process to change the density of the drilling fluid. Thus, systems and methods that enable the operating window (206) to increase without having to change the mud weight are beneficial. As such, the present disclosure presents systems and methods that enable the operating window (206) of the wellbore pressure profile (200) to increase beyond the ECD gradient (202) using a downhole choke system that varies the annular well pressure (i.e., the pressure in the annulus of the wellbore (102)).

Figure 3:
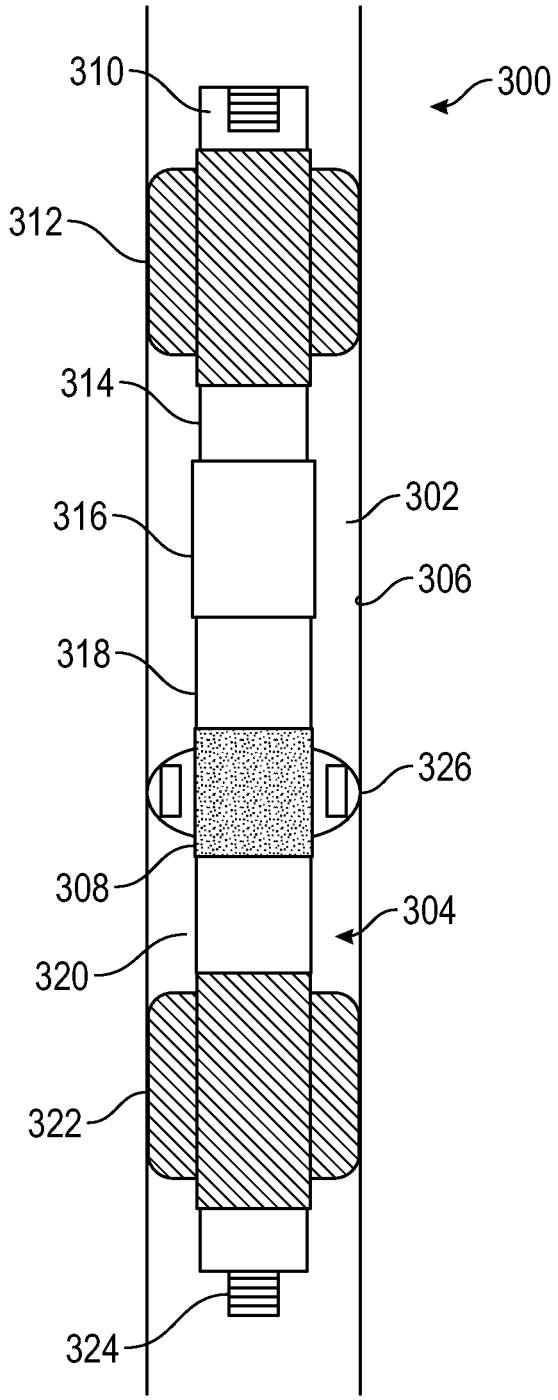
FIG. 3 shows a downhole tool in accordance with one or more embodiments.

FIG. 3 shows a downhole tool (300) in accordance with one or more embodiments. The downhole tool (300) is shown deployed in a casing string (302). An annulus (304) is formed between the downhole tool (300) and an inner circumferential surface (306) of the casing string (302). The annulus (304) may extend to a depth below the casing string (302) such that the annulus (304) is delineated by the drill string (108) and the wellbore (102) wall, without departing from the disclosure herein. The downhole tool (300) uses a choke (308) to block off the annulus (304) while the drilling fluid is still flowing. The interference in the annulus (304) causes pressure to build up in the annulus (304) which, in turn, increases the operating window (206) of the wellbore pressure profile (200) such that formations (104) similar to formation B (104*b*) can be drilled without needing to change the density of the drilling fluid.

The casing string (302) is a large-diameter pipe made of a durable material, such as steel. In accordance with one or more embodiments the casing string (302) is cemented in a wellbore (102). The casing string (302) prevents formation fluids from migrating to the surface. The casing string (302) may also be used to isolate formations (104) from one another.

In accordance with one or more embodiments, the downhole tool (300) includes an upper connection element (310), an upper stabilizer (312), a communication and power element (314), a controller (316), upper instrumentation (318), a choke (308), lower instrumentation (320), a lower stabilizer (322), and a lower connection element (324).

Specifically, FIG. 3 shows the upper connection element (310) connected to the upper stabilizer (312), the upper stabilizer (312) connected to the communication and power element (314), the communication and power element (314) connected to the controller (316), the controller (316) connected to the upper instrumentation (318), the upper instrumentation (318) connected to the choke (308), the choke (308) connected to the lower instrumentation (320), the lower instrumentation (320) connected to the lower stabilizer (322), and the lower stabilizer (322) connected to the lower connection element (324).

However, the downhole tool (300) may have any configuration of the aforementioned components without departing from the scope of the disclosure herein. Further, the components of the downhole tool (300) may be spaced out using various tubulars or other pieces of equipment. All of the connections between the aforementioned components allow for any required transmissions across the downhole tool (300) such as electrical, hydraulic, electromagnetic, acoustic, etc. The connections between the components of the downhole tool (300) may be any type of connection known in the art, such as threaded connections, welded connections, nut and bolt connections, etc.

In accordance with one or more embodiments, the components of the downhole tool (300) may be removable from one another for maintenance or use in other applications. However, the downhole tool (300) may be assembled together as a complete tool string prior to transportation to the well site (100).

The upper connection element (310) and the lower connection element (324) are configured to mate with corresponding connection elements (not pictured) on a drill string (108). The upper connection element (310) is shown as a box end which would mate with a pin end on the drill string (108) through a threaded connection. The lower connection element (324) is shown as a pin end which would mate with a box end on the drill string (108) through a threaded connection.

However, the upper connection element (310), the lower connection element (324), and the corresponding connection elements on the drill string (108) may be any type of connection elements known in the art that allows the downhole tool (300) to connect to a drill string (108), such as the depicted threaded connections, welded connections, nut and bolt connections, etc. In further embodiments, the upper connection element (310) and the lower connection element (324) provide mechanical, electrical, acoustic, and electromagnetic connections between the downhole tool (300) and the drill string (108).

FIG. 3 shows both an upper stabilizer (312) and a lower stabilizer (322); however, the downhole tool (300) may have as many stabilizers as required without departing from the scope of the disclosure herein. The upper stabilizer (312) and the lower stabilizer (322) are used to centralize the choke (308) within the center of the casing string (302). The upper stabilizer (312) and the lower stabilizer (322) are also used to protect the downhole tool (300) during installation and operational phases, including tripping and drilling.

The communication and power element (314) is shown as a singular element; however, the components of the communication and power element (314) may be spaced out at different locations within the downhole tool (300) without departing from the disclosure herein. The communication and power element (314) provides power to the downhole tool (300). Specifically, the communication and power element (314) may have an onboard battery that provides power to the rest of the downhole tool (300).

In other embodiments, the communication and power element (314) has an electrical connection that receives power from a surface location and the power is transmitted to the communication and power element (314) through wired drill pipe in the drill string (108). In other embodiments, the communication and power element (314) is configured to create power using hydraulics directly from the circulatory system.

Figure 7:
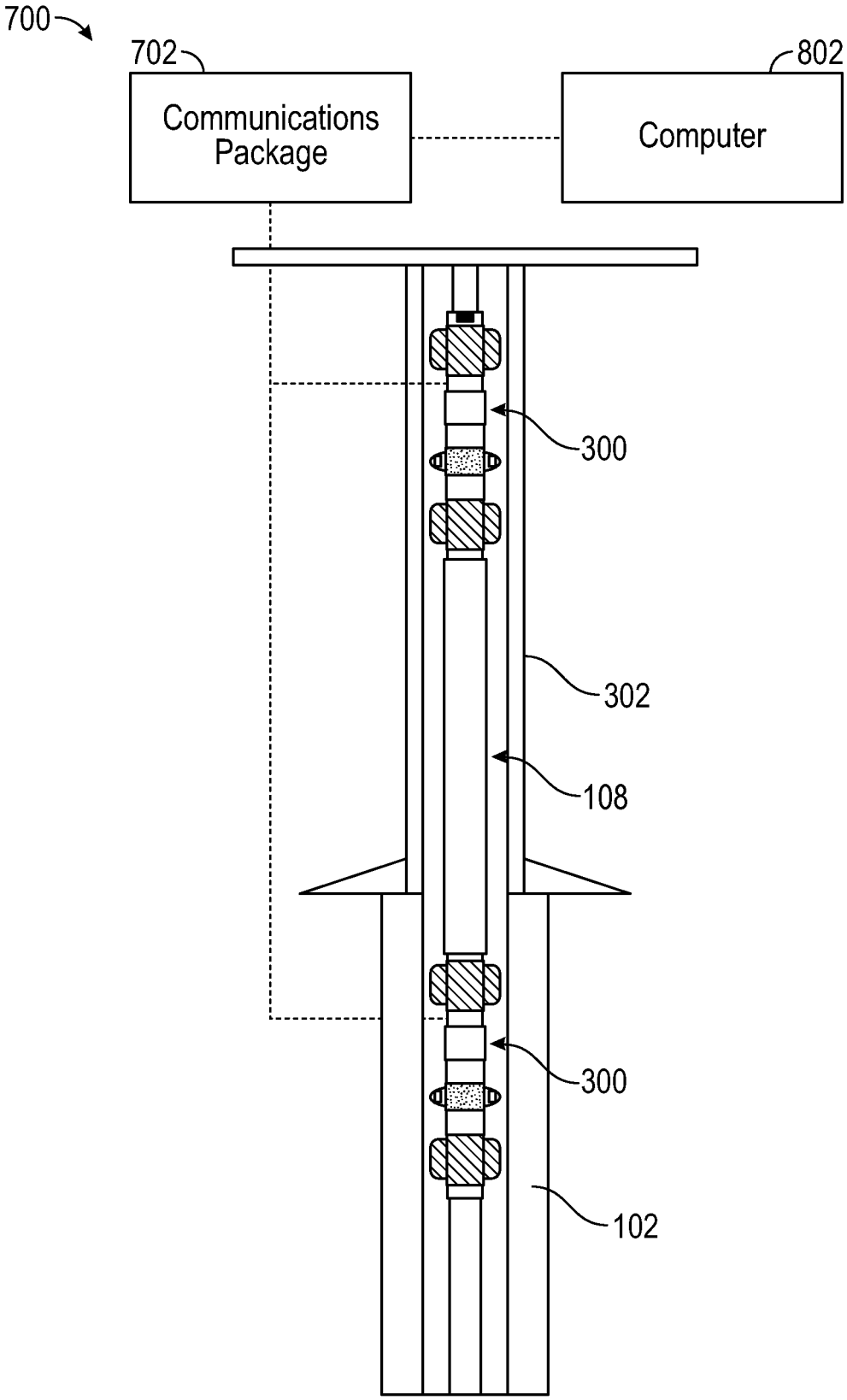
FIG. 7 shows a system using the downhole tool in accordance with one or more embodiments.

The communication and power element (314) also allows for communication between the downhole tool (300) and equipment at the surface (discussed further in FIG. 7). In accordance with one or more embodiments, direct communication and control is provided by conventional downhole bottom hole assembly tool control, such as pressure cycling techniques, string manipulation, mud pulse type telemetry and ball-drop actuation, or radio-frequency identification-type instruction.

Alternative higher speed communications may be achieved through wired connections (i.e., wired drill-pipe), acoustic, or electromagnetic techniques. In further embodiments, the downhole tool (300) is able to operate autonomously using a program stored on a downhole computer processor, not pictured, located in the communication and power element (314).

FIG. 3 shows the downhole tool having both upper instrumentation (318) and lower instrumentation (320); however, the downhole tool (300) may have one or more locations of instrumentation without departing from the scope of the disclosure herein. The upper instrumentation (318) and the lower instrumentation (320) includes one or more sensors that are able to obtain downhole data and provide tool operational status and performance feedback. The downhole data obtained by the upper instrumentation (318) and lower instrumentation (320) may include pressure measurements and that may be used to calculate dynamic and steady state annular pressure status changes.

The choke (308) includes an expandable element (326) that has an expanded position, an expanding position, and an unexpanded position. FIG. 3 shows the expandable element (326) in the expanded position. The expanded position occurs when the expandable element (326) is sealed against the inner circumferential surface (306) of the casing string (302). The unexpanded position occurs when the expandable element (326) is in a retracted position near or within the choke (308). An expanding position may occur when the expandable element (326) is in the process of expanding from the unexpanded position to the expanded position.

In accordance with one or more embodiments, the pressure in the annulus (304) may be varied by expanding the expandable element (326) within the annulus (304). The expandable element (326) may be completely expanded to the expanded position in order to increase the pressure in the annulus (304). However, the expandable element (326) need only be in the expanding position to increase the pressure in the annulus (304).

The expandable element (326) may be of differing designs, depending on application. For example, the size of the unexpanded and expanded diameters may differ depending on the size of the casing string (302) and the material make-up of the expandable element (326) may differ depending on drilling fluid properties, downhole temperatures, and operating pressures. In accordance with one or more embodiments, the expandable element (326) may include elastomer-type elements in combination with multiple variable-in-size orifice-type devices.

In accordance with one or more embodiments, the choke (308) may operate in casing string (302) sections of 18¾" to 7" (which equates to a choke (308) outer diameter range of 160 mm to 460 mm). The choke (308) may be fast acting and may transition between the expanded position and the unexpanded position in less than 30 seconds.

In further embodiments, the choke (308) may add back-pressure to the annulus (304) in incremental steps, such as 50 psi, 100 psi, 150 psi, etc. The choke (308) may have the ability to have a calibrated response through repeatability in consistent drilling fluid environments. Further, the choke (308) may have a default position that is the unexpanded position such that there is minimal back pressure downhole from the choke (308).

The controller (316) is configured to place the choke (308) system in the expanded position, the expanding position, and the expanded position. Specifically, the controller (316) may regulate the choke (308) system automatically using surface parameter set points that have been determined by the use of drilling hydraulic simulation models. In other embodiments, the controller (316) may regulate the choke (308) using instructions sent from the communication and power element (314). The power used to operate the choke (308) may come to the controller (316) from the communication and power element (314).

In one or more embodiments, the instructions may come to the communication and power element (314) from the surface. In other embodiments, the communication and power element (314) may use the program stored on the downhole computer processor (not pictured) to analyze the downhole data obtained through the upper instrumentation (318) and the lower instrumentation (320) and produce an instruction for the controller (316).

The controller (316) may regulate the choke (308) system using packer activation technologies. For example, the controller (316) may include a hydraulic system or a mechanical system and may regulate the choke (308) hydraulically or mechanically. A mechanical controller (316) may include a force generation system, such as an actuator coupled to a motor. The motor may be an electric motor or a hydraulic motor. The actuator may transfer force to the choke (308) system using a mechanical linkage, such as a threading system or slip system, to manipulate the choke (308).

A hydraulic controller (316) may pump hydraulic fluid into and out of the choke (308) system to expand and contract the expandable element (326). Specifically, the hydraulic controller (316) may include a pump and valve system that fills and empties a chamber located between the body of the tool and the expandable element (326).

Figure 4:
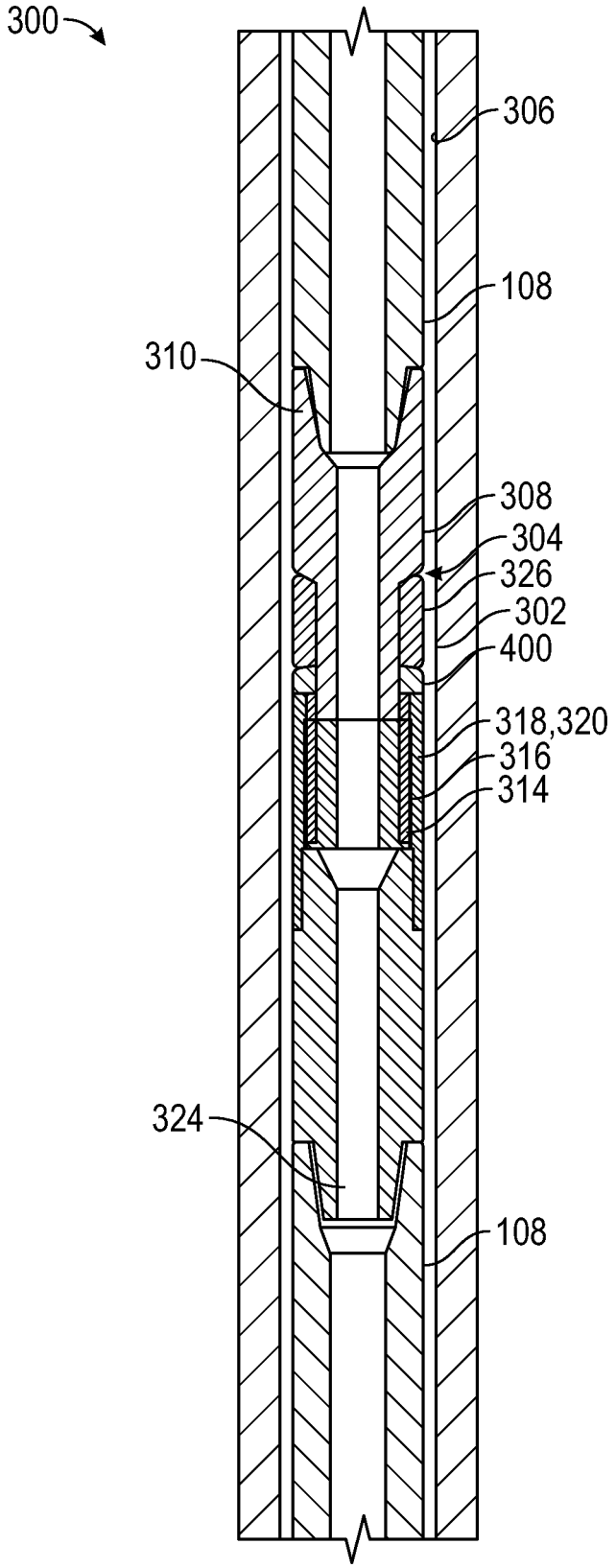
FIG. 4 shows the downhole tool in accordance with one or more embodiments.

FIG. 4 shows the downhole tool (300) in accordance with one or more embodiments. Components shown in FIG. 4 that are the same as or similar to components shown in FIG. 3 have not been redescribed for purposes of readability and have the same description and function as outlined above.

Specifically, FIG. 4 shows an alternate configuration of the downhole tool (300) introduced in FIG. 3. The downhole tool (300) is installed within a drill string (108) and is shown in the "not active" position, meaning that the expandable element of the choke (308) system is in the unexpanded position. In FIG. 4, the expandable element (326), the instrumentation (318, 320), the controller (316), and the communication and power element (314) are all shown as part of the choke (308) system, rather than being sperate components. The choke (308) system shown in FIG. 4 is a mechanical actuation system that uses an actuator (400) that works with the controller (316) to expand or retract the expandable element (326) of the choke (308).

Figure 5:
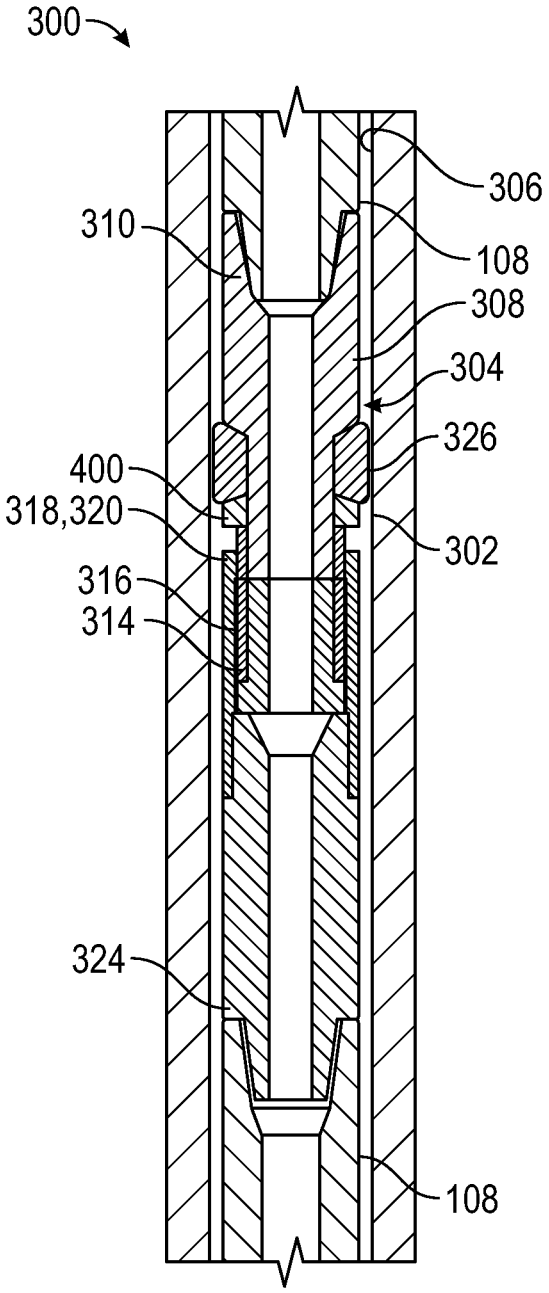
FIG. 5 shows the downhole tool in accordance with one or more embodiments.

FIG. 5 shows the downhole tool (300) in accordance with one or more embodiments. Components shown in FIG. 5 that are the same as or similar to components shown in FIGS. 3 and 4 have not been redescribed for purposes of readability and have the same description and function as outlined above.

Specifically, FIG. 5 shows an alternate configuration of the downhole tool (300) introduced in FIG. 3. The downhole tool (300) is installed within a drill string (108) and is shown in the "active" position, meaning that the expandable element of the choke (308) system is in the expanding position. In FIG. 5, the expandable element (326), the instrumentation (318, 320), the controller (316), and the communication and power element (314) are all shown as part of the choke (308) system, rather than being sperate components. Further, an actuator (400) is shown. The actuator (400) is in communication with the controller (316) such that the controller (316) activates the actuator (400) to expand or retract the expandable element (326).

Figure 6:
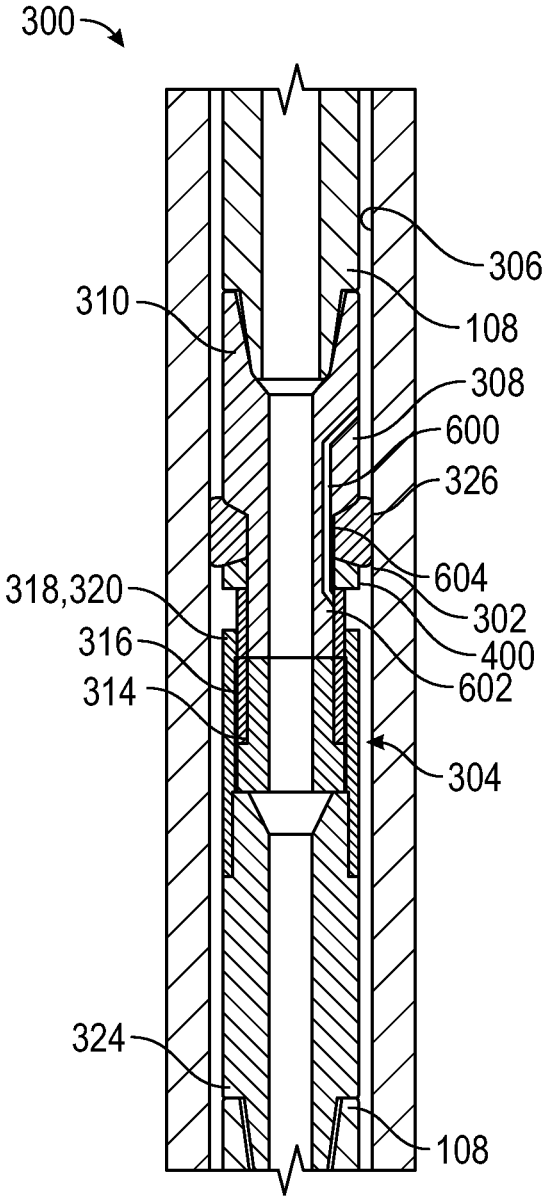
FIG. 6 shows the downhole tool in accordance with one or more embodiments.

FIG. 6 shows the downhole tool (300) in accordance with one or more embodiments. Components shown in FIG. 6 that are the same as or similar to components shown in FIGS. 3-5 have not been redescribed for purposes of readability and have the same description and function as outlined above.

Specifically, FIG. 6 shows an alternate configuration of the downhole tool (300) introduced in FIG. 3. The downhole tool (300) is installed within a drill string (108). In FIG. 6, the expandable element (326), the instrumentation (318, 320), the controller (316), and the communication and power element (314) are all shown as part of the choke (308) system, rather than being sperate components. Further, an actuator (400) is shown. The actuator (400) is in communication with the controller (316) such that the controller (316) activates the actuator (400) to expand or retract the expandable element (326).

The expandable element (326) is shown in the expanded position. A bearing (604) is located between the expandable element (326) and the remainder of the choke (308) system. The bearing (604) prevents premature wearing of the expandable element (326). In further embodiments, the choke (308) system is shown having an internal flow path (600) that allows a fluid, such as the drilling fluid, to flow through an inside of the choke (308). An internal valve (602) is located within the internal flow path (600). The internal valve (602) may be actuated to allow or stop fluid from flowing through the inside of the choke (308). This configuration allows for more specific variations in the pressure in the annulus (304).

FIG. 7 shows a system using the downhole tool (300) in accordance with one or more embodiments. Components shown in FIG. 6 that are the same as or similar to components shown in FIGS. 1-6 have not been redescribed for purposes of readability and have the same description and function as outlined above.

Specifically, FIG. 7 shows two downhole tools (300) installed on the drill string (108) deployed in the well. Two or more downhole tools (300) may be installed on the drill string in scenarios where the first downhole tool (300) is about to enter the open hole section of the well (i.e., exit out of the casing string (302) into the wellbore (102)) and pressure control may still be required in the deeper formations (104). In such scenarios, the second downhole tool installed on the drill string (108) will be used in deeper formations (104) to control the annular pressures.

FIG. 7 further shows the surface system (700) used to communicate with the downhole tool (300). The surface system (700) includes a communication package (702) and a computer (802). The surface system (700) may also include tools used to put together and configure the downhole tool (300). The computer is further outlined in FIG. 8, below. The computer (802) may include a hydraulic model simulator. The computer (802) is configured to visualize and analyze the downhole data and send instructions to the communication and power element (314) via the communication package (702).

The communication package may be any type of communication package known in the art such as a hydraulic communication package, an electronic communication package, an electromagnetic communication package, an acoustic communication package, etc.

In accordance with one or more embodiments, the communication package (702) is an electronic communication package, and the surface system (700) is electronically connected to the communication and power element (314) using electronic connections within the drill string (108). Instructions are sent to the communication and power element (314) from the surface system (700) and the downhole data is sent from the communication and power element (314) to the surface system (700) via electronic signals.

In accordance with one or more embodiments, the communication package (702) is a hydraulic communication package, and the surface system (700) is hydraulically connected to the communication and power element (314). Instructions are sent to the communication and power element (314) from the surface system (700) and the downhole data is sent from the communication and power element (314) to the surface system (700) via hydraulic signals.

In accordance with one or more embodiments, the communication package (702) is an electromagnetic communication package, and the surface system (700) is electromagnetically connected to the communication and power element (314). Instructions are sent to the communication and power element (314) from the surface system (700) and the downhole data is sent from the communication and power element (314) to the surface system (700) via electromagnetic signals.

In accordance with one or more embodiments, the communication package (702) is an acoustic communication package, and the surface system (700) is acoustically connected to the communication and power element (314). Instructions are sent to the communication and power element (314) from the surface system (700) and the downhole data is sent from the communication and power element (314) to the surface system (700) via acoustic signals.

Figure 8:
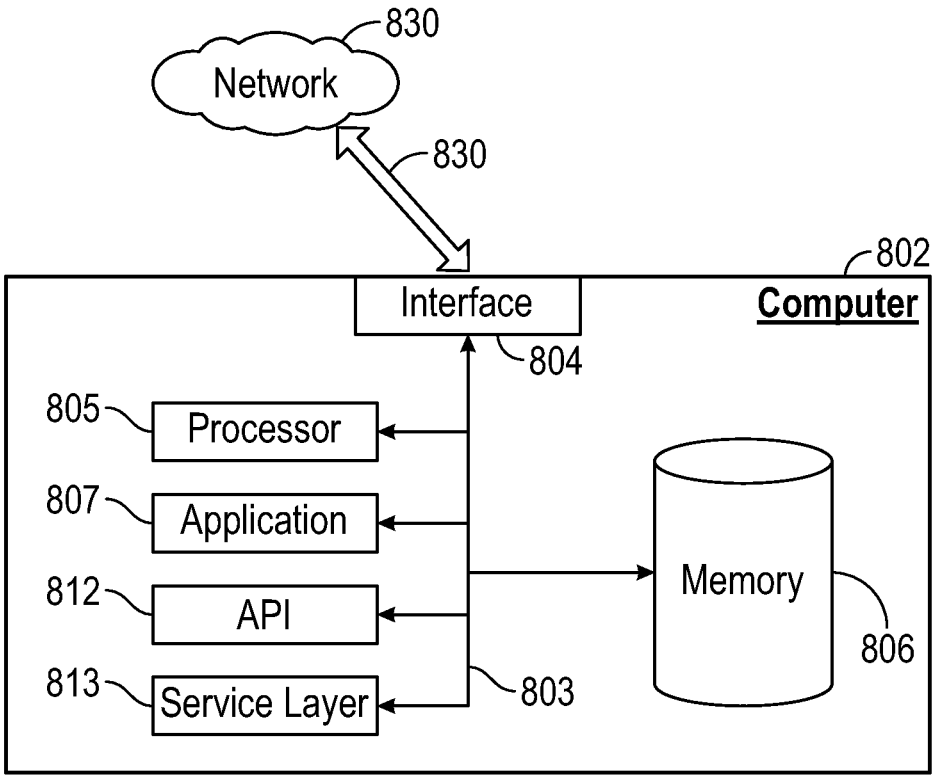
FIG. 8 shows a computer system in accordance with one or more embodiments.

FIG. 8 shows a computer (802) system in accordance with one or more embodiments. Specifically, FIG. 8 shows a block diagram of a computer (802) system used to provide computational functionalities associated with described algorithms, methods, functions, processes, flows, and procedures as described in the instant disclosure, according to an implementation. The illustrated computer (802) is intended to encompass any computing device such as a server, desktop computer, laptop/notebook computer, wireless data port, smart phone, personal data assistant (PDA), tablet computing device, one or more processors within these devices, or any other suitable processing device, including both physical or virtual instances (or both) of the computing device.

Additionally, the computer (802) may include a computer that includes an input device, such as a keypad, keyboard, touch screen, or other device that can accept user information, and an output device that conveys information associated with the operation of the computer (802), including digital data, visual, or audio information (or a combination of information), or a GUI.

The computer (802) can serve in a role as a client, network component, a server, a database or other persistency, or any other component (or a combination of roles) of a computer system for performing the subject matter described in the instant disclosure. The illustrated computer (802) is communicably coupled with a network (830). In some implementations, one or more components of the computer (802) may be configured to operate within environments, including cloud-computing-based, local, global, or other environment (or a combination of environments).

At a high level, the computer (802) is an electronic computing device operable to receive, transmit, process, store, or manage data and information associated with the described subject matter. According to some implementations, the computer (802) may also include or be communicably coupled with an application server, e-mail server, web server, caching server, streaming data server, business intelligence (BI) server, or other server (or a combination of servers).

The computer (802) can receive requests over network (830) from a client application (for example, executing on another computer (802)) and responding to the received requests by processing the said requests in an appropriate software application. In addition, requests may also be sent to the computer (802) from internal users (for example, from a command console or by other appropriate access method), external or third-parties, other automated applications, as well as any other appropriate entities, individuals, systems, or computers.

Each of the components of the computer (802) can communicate using a system bus (803). In some implementations, any or all of the components of the computer (802), both hardware or software (or a combination of hardware and software), may interface with each other or the interface (804) (or a combination of both) over the system bus (803) using an application programming interface (API) (812) or a service layer (813) (or a combination of the API (812) and service layer (813). The API (812) may include specifications for routines, data structures, and object classes. The API (812) may be either computer-language independent or dependent and refer to a complete interface, a single function, or even a set of APIs. The service layer (813) provides software services to the computer (802) or other components (whether or not illustrated) that are communicably coupled to the computer (802).

The functionality of the computer (802) may be accessible for all service consumers using this service layer. Software services, such as those provided by the service layer (813), provide reusable, defined business functionalities through a defined interface. For example, the interface may be software written in JAVA, C++, or other suitable language providing data in extensible markup language (XML) format or other suitable format. While illustrated as an integrated component of the computer (802), alternative implementations may illustrate the API (812) or the service layer (813) as stand-alone components in relation to other components of the computer (802) or other components (whether or not illustrated) that are communicably coupled to the computer (802). Moreover, any or all parts of the API (812) or the service layer (813) may be implemented as child or sub-modules of another software module, enterprise application, or hardware module without departing from the scope of this disclosure.

The computer (802) includes an interface (804). Although illustrated as a single interface (804) in FIG. 8, two or more interfaces (804) may be used according to particular needs, desires, or particular implementations of the computer (802). The interface (804) is used by the computer (802) for communicating with other systems in a distributed environment that are connected to the network (830). Generally, the interface (804) includes logic encoded in software or hardware (or a combination of software and hardware) and operable to communicate with the network (830). More specifically, the interface (804) may include software supporting one or more communication protocols associated with communications such that the network (830) or interface's hardware is operable to communicate physical signals within and outside of the illustrated computer (802).

The computer (802) includes at least one computer processor (805). Although illustrated as a single computer processor (805) in FIG. 8, two or more processors may be used according to particular needs, desires, or particular implementations of the computer (802). Generally, the computer processor (805) executes instructions and manipulates data to perform the operations of the computer (802) and any algorithms, methods, functions, processes, flows, and procedures as described in the instant disclosure.

The computer (802) also includes a non-transitory computer (802) readable medium, or a memory (806), that holds data for the computer (802) or other components (or a combination of both) that can be connected to the network (830). For example, memory (806) can be a database storing data consistent with this disclosure. Although illustrated as a single memory (806) in FIG. 8, two or more memories may be used according to particular needs, desires, or particular implementations of the computer (802) and the described functionality. While memory (806) is illustrated as an integral component of the computer (802), in alternative implementations, memory (806) can be external to the computer (802).

The application (807) is an algorithmic software engine providing functionality according to particular needs, desires, or particular implementations of the computer (802), particularly with respect to functionality described in this disclosure. For example, application (807) can serve as one or more components, modules, applications, etc. Further, although illustrated as a single application (807), the application (807) may be implemented as multiple applications (807) on the computer (802). In addition, although illustrated as integral to the computer (802), in alternative implementations, the application (807) can be external to the computer (802).

There may be any number of computers (802) associated with, or external to, a computer system containing computer (802), each computer (802) communicating over network (830). Further, the term "client," "user," and other appropriate terminology may be used interchangeably as appropriate without departing from the scope of this disclosure. Moreover, this disclosure contemplates that many users may use one computer (802), or that one user may use multiple computers (802).

Figure 9:
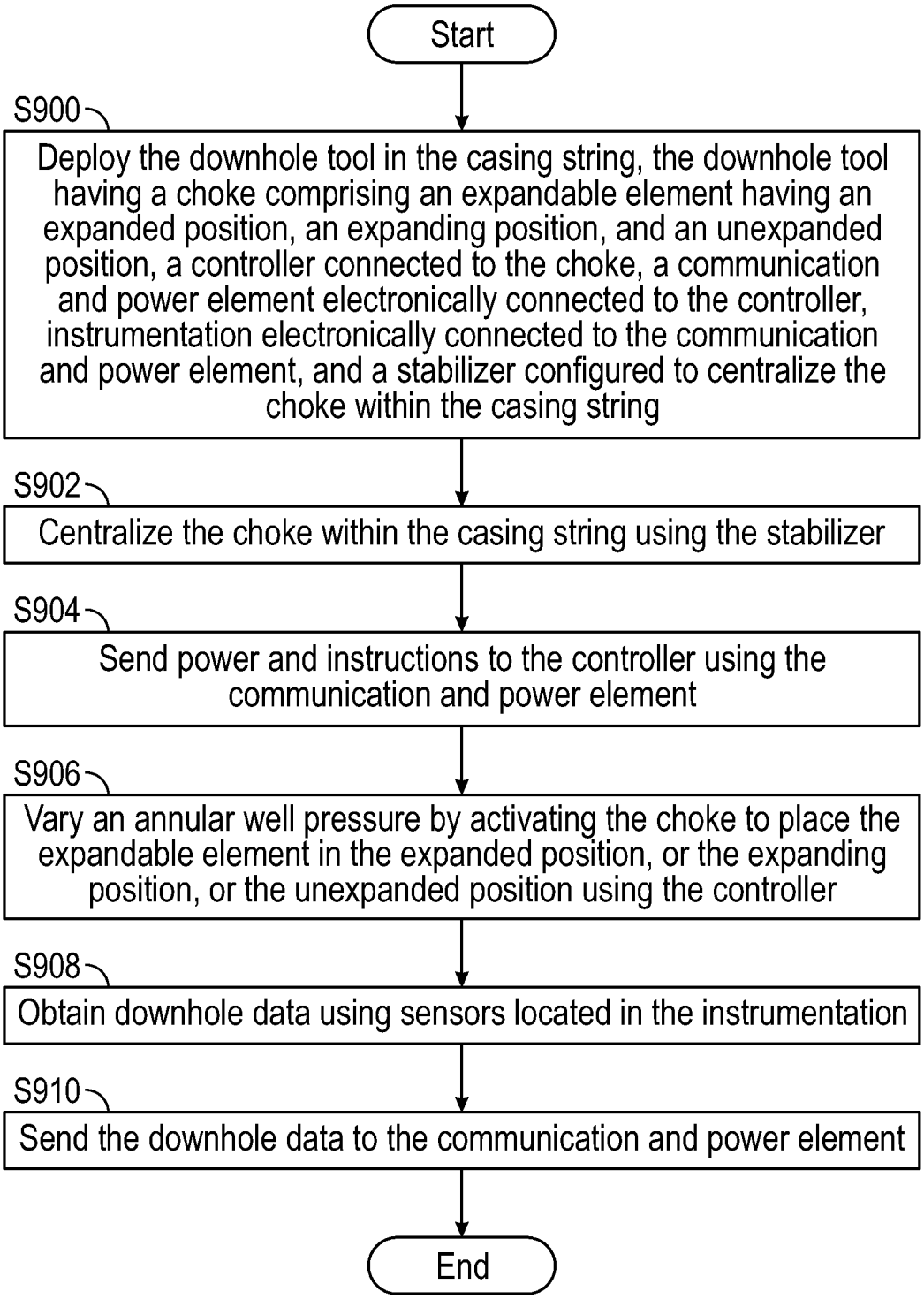
FIG. 9 shows a flowchart in accordance with one or more embodiments.

FIG. 9 shows a flowchart in accordance with one or more embodiments. The flowchart outlines a method for using a downhole tool (300) in a casing string (302). While the various blocks in FIG. 9 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

In step 900, the downhole tool (300) is deployed in the casing string. The downhole tool has a choke (308) comprising an expandable element (326) having an expanded position, an expanding position, and an unexpanded position, a controller (316) connected to the choke (308), a communication and power element (314) electronically connected to the controller (316), instrumentation (318, 320) electronically connected to the communication and power element (314), and a stabilizer (312, 322) configured to centralize the choke (308) within the casing string (302).

In accordance with one or more embodiments, the downhole tool (300) is connected to a drill string (108) at a surface location. The downhole tool (300) is connected to the drill string (108) using an upper connection element (310) and a lower connection element (324) that mate with corresponding connection elements on the drill string (108). In further embodiments, the downhole tool (300) is communicatively connected to a surface system (700) that includes a communication package (702) and a computer (802).

In accordance with one or more embodiments, and while the downhole tool (300) is being connected to the drill string (108), a hydraulic model system should be used to ensure correct configuration of the downhole tool (300). The surface system (700) may be configured and calibrated to communicate with the downhole tool (300). The downhole tool (300) may be installed within the drill pipe of the drill string (108). The downhole tool (300) may be installed in the drills string (108) when the drills string (108) approaches the bottom of the previously drilled section (i.e., around 200 feet above total depth (TD)). Once the downhole tool (300) has been tripped to below the flowline, the downhole tool (300) may be tested and calibrated and drilling ahead may begin.

In step 902, the choke (308) is centralized within the casing string (302) using the stabilizer (312, 322). The choke (308) may be centralized in the casing string (302) during tripping, drilling, or during operation of the downhole tool (300). Centralization in the casing string (302) protects the downhole tool (300) during tripping and drilling operations and allows the expandable element (326) on the choke (308) to seal against the inner circumferential surface (306) of the casing string (302) when the expandable element (326) is in the expanded position. In accordance with one or more embodiments, there may be more than one stabilizer (312, 322), such as an upper stabilizer (312) and a lower stabilizer (322), without departing from the scope of the disclosure herein.

In step 904, power and instructions are sent to the controller (316) using the communication and power element (314). In accordance with one or more embodiments, the controller (316) may produce its own power, via an onboard battery, and its own instructions, via a downhole computer processor having a program. In other embodiments, the communication and power element (314) may receive power and instructions from the communication package (702) at the surface system (700). The instructions may be sent via signals from the communication package (702).

Further, the computer (802) may send the signals to the communication package to be sent downhole to the communication and power element (314). The communication package and the signals may be any type known in the art, such as electronic, hydraulic, acoustic, electromagnetic, etc.

In step 906, an annular well pressure is varied by activating the choke (308) to place the expandable element (326) in the expanded position, the expanding position, or the unexpanded position using the controller (316). When the choke (308) system is in the expanded or expanding position, the expandable element (326) blocks flow in the annulus (304) which creates a buildup of pressure in the annulus (304) due to the continuous circulation of the drilling fluid. This allows for the wellbore pressure to build up allowing the operating window (206) to increase.

In further embodiments, when the choke (308) system is activated to place the expandable element (326) in the expanded position, the drilling fluid may be allowed to flow through the choke (308) using an internal flow path (600). Further, an internal valve (602) may be located in the internal flow path (600). The internal valve (602) may be actuated to allow or stop the fluid from flowing through the choke (308).

In step 908, downhole data is obtained using sensors located in the instrumentation (318, 320). There may be instrumentation (318, 320) located at different locations within the downhole tool (300) such that readings may be obtained downhole from the choke (308) and up hole from the choke (308). In step 910, the downhole data is sent to the communication and power element (314).

The downhole data may be analyzed by the program on the downhole computer processor in the communication and power element (314) to come up with an instruction for the controller (316). In other embodiments, the downhole data may be sent from the communication and power element (314) to the computer (802) via the communication package (702). The computer (802) may analyze the data and instructions may be sent from the computer (802) to the communication and power element (314) via the communication package (702).

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112(f) for any limitations of any of the claims herein, except for those in which the claim expressly uses the words 'means for' together with an associated function.

What is claimed:

1. A downhole tool for deployment in a casing string, the downhole tool comprising:

a choke configured to vary an annular well pressure and comprising an expandable element having an expanded position, an expanding position, and an unexpanded position, wherein the expanded position comprises the expandable element sealed against an inner circumferential surface of the casing string;

a controller connected to the choke and having a hydraulic system that uses fluid or a mechanical system that uses a force generation system to place the choke in the expanded position, the expanding position, and the unexpanded position;

a communication and power element electronically connected to the controller, wherein power and instructions are sent to the controller from the communication and power element;

instrumentation electronically connected to the communication and power element, wherein the instrumentation comprises sensors configured to obtain downhole data and the downhole data is sent to the communication and power element; and a stabilizer configured to centralize the choke within the casing string.

2. The downhole tool of claim 1, wherein the choke, in the expanded position, further comprises an internal flow path allowing a fluid to flow through an inside of the choke.

3. The downhole tool of claim 2, wherein the choke further comprises an internal valve located within the internal flow path and configured to allow or stop fluid flow through the inside of the choke.

4. The downhole tool of claim 1, further comprising connection elements configured to mate with corresponding connection elements on a drill string to connect the downhole tool to the drill string.

5. The downhole tool of claim 4, further comprising a surface system connected to the drill string and comprising a communication package and a computer.

6. The downhole tool of claim 5, wherein the computer is configured to visualize and analyze the downhole data and send instructions to the communication and power element via the communication package.

7. The downhole tool of claim 6, wherein the communication package comprises an electronic communication package and the surface system is electronically connected to the communication and power element using electronic connections within the drill string.

8. The downhole tool of claim 7, wherein instructions are sent to the communication and power element from the surface system and the downhole data is sent from the communication and power element to the surface system via electronic signals.

9. The downhole tool of claim 6, wherein the communication package comprises a hydraulic communication package and the surface system is hydraulically connected to the communication and power element.

10. The downhole tool of claim 9, wherein instructions are sent to the communication and power element from the surface system and the downhole data is sent from the communication and power element to the surface system via hydraulic signals.

11. A method for using a downhole tool in a casing string, the method comprising:

deploying the downhole tool in the casing string, the downhole tool comprising:

a choke comprising an expandable element having an expanded position, an expanding position, and an unexpanded position;

a controller connected to the choke;

a communication and power element electronically connected to the controller;

instrumentation electronically connected to the communication and power element; and a stabilizer configured to centralize the choke within the casing string;

centralizing the choke within the casing string using the stabilizer;

sending power and instructions to the controller using the communication and power element;

varying an annular well pressure by activating the choke to place the expandable element in the expanded position, the expanding position, or the unexpanded position using the controller, wherein the controller activates the choke to place the expandable element in the expanded position, the expanding position, or the unexpanded position using a mechanical system that uses a force generation system or a hydraulic system that uses a fluid;

obtaining downhole data using sensors located in the instrumentation; and sending the downhole data to the communication and power element.

12. The method of claim 11, wherein activating the choke to place the expandable element in the expanded position further comprises allowing a fluid to flow through the choke using an internal flow path.

13. The method of claim 12, wherein allowing the fluid to flow through the choke further comprises allowing or stopping fluid flow within the choke using an internal valve located within the internal flow path.

14. The method of claim 11, wherein deploying the downhole tool in the casing string comprises connecting the downhole tool to a drill string by mating connection elements on the downhole tool to corresponding connection elements on the drill string.

15. The method of claim 14, wherein deploying the downhole tool in the casing string further comprises connecting the drill string to a surface system comprising a communication package and a computer.

16. The method of claim 15, further comprising sending the downhole data to the computer from the communication and power element via the communication package, analyzing the downhole data using the computer, and sending instructions from the computer to the communication and power element via the communication package.

17. The method of claim 16, wherein the communication package comprises an electronic communication package and the surface system is electronically connected to the communication and power element using electronic connections within the drill string.

18. The method of claim 17, wherein sending power and instructions to the controller using the communication and power element further comprises sending instructions to the communication and power element using electronic signals from the communication package.

19. The method of claim 16, wherein the communication package comprises a hydraulic communication package and the surface system is hydraulically connected to the communication and power element.

20. The method of claim 19, wherein sending power and instructions to the controller using the communication and power element further comprises sending instructions to the communication and power element using hydraulic signals from the communication package.

* * * * *